United States Patent [19]

Riley

[11] 4,428,526

[45] Jan. 31, 1984

[54] REPLY CARD ARRANGEMENT WITH CONFIDENTIALITY FLAP

[75] Inventor: James E. Riley, Deerfield, Ill.

[73] Assignee: The Wessel Company, Inc., Elk Grove Village, Ill.

[21] Appl. No.: 351,923

[22] Filed: Feb. 24, 1982

[51] Int. Cl.[3] ..... B42D 15/08

[52] U.S. Cl. ..... 229/92.8; 229/92.1

[58] Field of Search ..... 229/92.1, 92.8, 92.7, 229/92.3, 71

[56] References Cited

U.S. PATENT DOCUMENTS

| | | | |
|---|---|---|---|
| 338,746 | 3/1886 | Hofmann | 229/92.7 |
| 925,048 | 6/1909 | Smith | 229/71 |
| 2,270,455 | 1/1942 | Lichter | 229/92.1 |
| 4,011,985 | 3/1977 | Simson | 229/92.3 |

*Primary Examiner*—Steven M. Pollard
*Assistant Examiner*—David Voorhees
*Attorney, Agent, or Firm*—Merriam, Marshall & Bicknell

[57] ABSTRACT

A reply card arrangement comprises a reply card detachable from a plurality of folded pages. The reply card is composed of two sheet portions in superimposed relation and adhesively secured together along a side of each. A first sheet portion of the two ply reply card has discontinuous score lines thereon defining a detachable flap raisable from the first sheet portion to exposed to view a part of the inside surface of the second sheet of the two ply reply card. Confidential information may be entered on the exposed part which is then covered by the flap which may be secured to the second sheet portion with a wettable adhesive located along the margin of the flap.

6 Claims, 10 Drawing Figures

REPLY CARD ARRANGEMENT WITH CONFIDENTIALITY FLAP

BACKGROUND OF THE INVENTION

The present invention relates generally to folded printed material and more particularly to multi-page, folded, printed material including a detachable, self-addressed reply card.

Companies desiring to promote goods or services often do so using multi-page, folded, printed material including a self-addressed reply card detachable therefrom. The printed material consists of several pages joined together in an undulating folded manner, for example. Typically, there are three pages of printed material, each printed on both sides and joined together on alternating sides, i.e., in an undulating manner, so that all the pages are in a superimposed, stacked relation. The reply card is connected to one of the printed pages, typically along a perforated line, so that the reply card may be readily detached from that page.

The U.S. Postal Service refuses to handle reply cards unless they have a minimum thickness of 0.007 inches. A reply card of the type described above is an integral part of a paper strip which also includes, as other integral parts, the aforementioned pages of printed material. Rather than making all of these pages from the relatively thick paper stock required by the U.S. Postal Service for reply cards, a conventional reply card is typically fabricated from two sheet-like portions of relatively thin paper stock folded together in superimposed relation and adhered together along a side of each. The detachable connection between the reply card and the other pages of printed material is located adjacent that side.

One outer surface of the two-ply, conventional reply card contains the mailing address of the company offering the goods or services promoted on the printed pages. The other outer surface of the conventional reply card typically contains a space in which the offeree writes information when he responds to the offer of goods or services. In many instances, the offeree is requested to enter in writing information concerning his credit card, such as the credit card number and its date of expiration. After entering this information, the offeree detaches the reply card from the other pages of printed material and mails the card.

The type of reply card described above stimulates a relatively high frequency of response by offerees because so little work is involved on the part of the offeree. The offeree need merely fill in the information requested, tear off the reply card and mail it. No folding, stuffing or pasting is required on the part of the offeree.

However, a problem arises with conventional reply cards because the area on which the offeree enters his credit card information is exposed to view. There have been instances where mail handlers or employees of the offeror or others who have access to the reply cards use the credit card information, which is exposed to view on the reply cards, to order by telephone goods or services for pick up at "will call" while charging it to the credit card number obtained from the reply card.

SUMMARY OF THE INVENTION

The drawbacks and disadvantages of the conventional reply card arrangement are eliminated by a reply card arrangement constructed in accordance with the present invention.

As with conventional reply cards, the present reply card is composed of two sheet portions in superimposed relation and adhered together along a side of each. However, unlike conventional reply cards, if an offeree has to supply confidential information, such as a credit card number or credit card expiration date or the like, with the present reply card the offeree is not required to enter this information on an outside surface exposed to view. Instead, one of the two superimposed sheet portions of the reply card is provided with score lines defining thereon flap means raisable from the remainder of that sheet to expose to view a part of the inside surface of the other sheet portion of which the reply card is composed. The exposed part on the inside surface of the other sheet portion constitutes an area in which may be entered confidential information such as credit card information.

The score lines defining the flap are not continuous but are interrupted at spaced intervals by tiny connecting means for detachably connecting the flap to the remainder of the sheet portion so as to maintain the flap in the plane of that sheet portion until such time as the offeree is ready to enter the confidential information on the reply card.

The inside surface of the flap means has a marginal part adjacent the edge defined by the score lines, and adhesive means is applied on at least part of that marginal part for adhesively securing the flap means to the inside surface of the other sheet portion after the confidential information has been entered thereon. The flap is adhesively secured in the same manner as an envelope flap, e.g., by wetting the adhesive. Once the flap has been adhesively secured, the confidential information is no longer exposed to view and cannot be until the flap is torn open by the offeror upon receipt of the reply card.

The flap is provided with notch means in the marginal part thereof initially to facilitate detaching the flap from its sheet portion and then to facilitate opening the flap after it has been adhesively secured.

Other features and advantages are inherent in the structure claimed and disclosed or will become apparent to those skilled in the art from the following detailed description in conjunction with the accompanying diagrammatic drawings.

DETAILED DESCRIPTION

Figure 5:
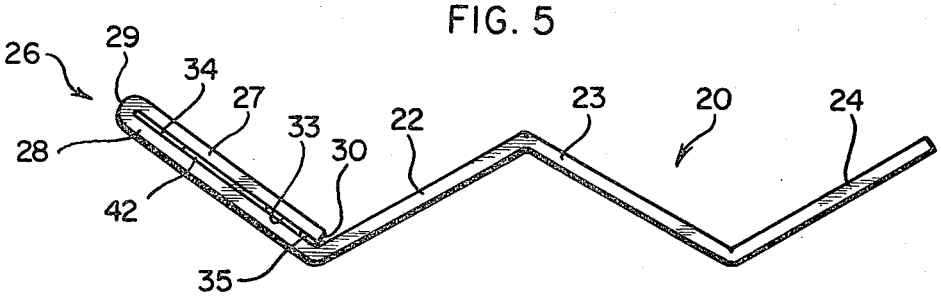
FIG. 5 is an end view of the reply card arrangement in its final fabricated form and partially folded.
Figure 6:
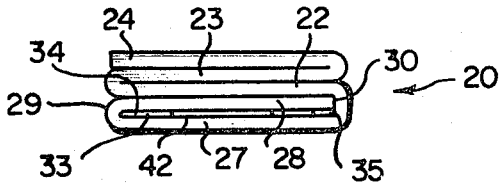
FIG. 6 is an end view of the reply card arrangement in a fully folded condition.
Figure 7:
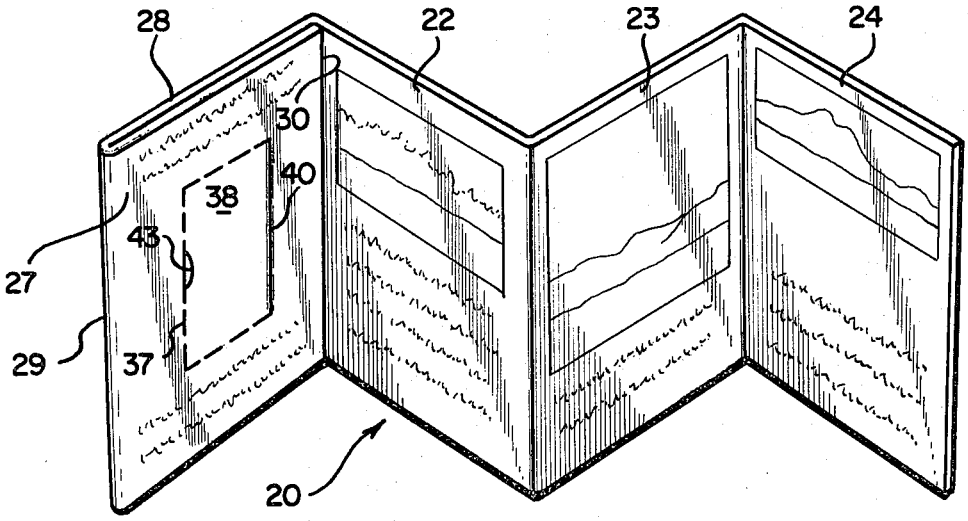
FIG. 7 is a perspective of the reply card arrangement partially unfolded.

Referring initially to FIGS. 5–7, indicated generally at 20 is a reply card arrangement constructed in accordance with an embodiment of the present invention. Reply card arrangement 20 is made from a sheet having a number of portions and comprises, for example, three pages of printed material, 22–24, each of which has printing on both sides thereof. Detachably joined to page 22 is a reply card 26 comprising a first sheet portion 27 having spaced apart first and second sides 29, 30, respectively. Reply card 26 also comprises a second sheet portion 28 also having spaced apart first and second sides 29, 31, respectively. First sheet portion 27 is in superimposed relation to second sheet portion 28 and is integrally joined thereto at a fold line along their mutual first side 29. Sheet portion 28 is detachably joined to page 22 at a tearable connection (e.g., a perforated line) located along second side 31 of sheet portion 28.

Figure 1:
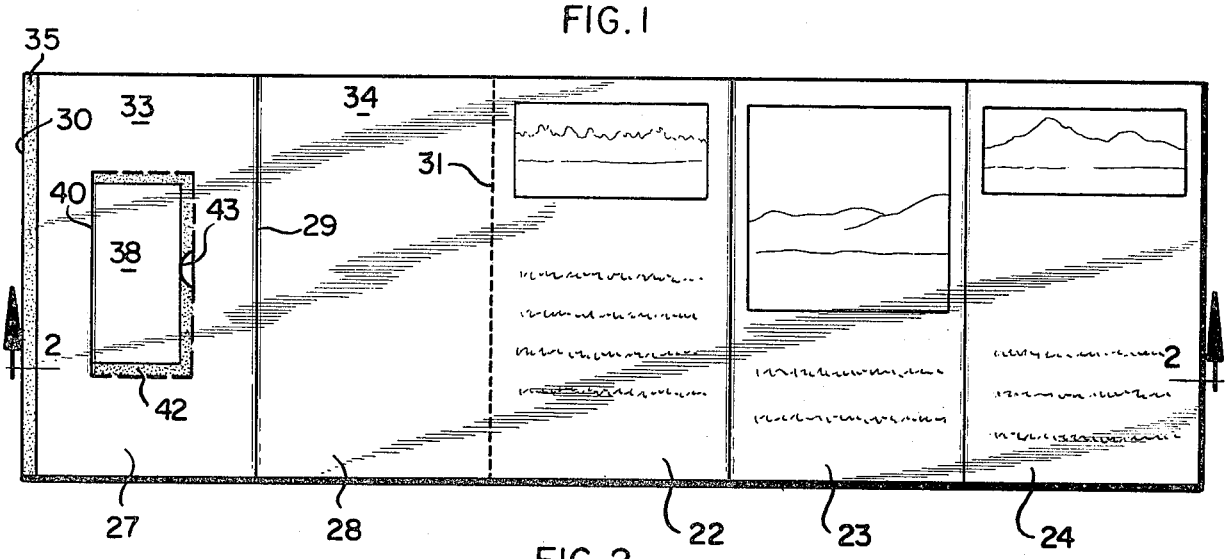
FIG. 1 is a plan view of a reply card arrangement in accordance with an embodiment of the present invention and shows the arrangement during fabrication thereof.
Figure 2:
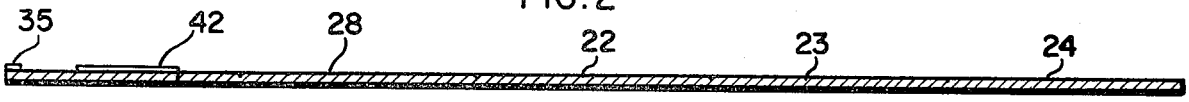
FIG. 2 is a sectional view taken along 2—2 in FIG. 1.
Figure 3:
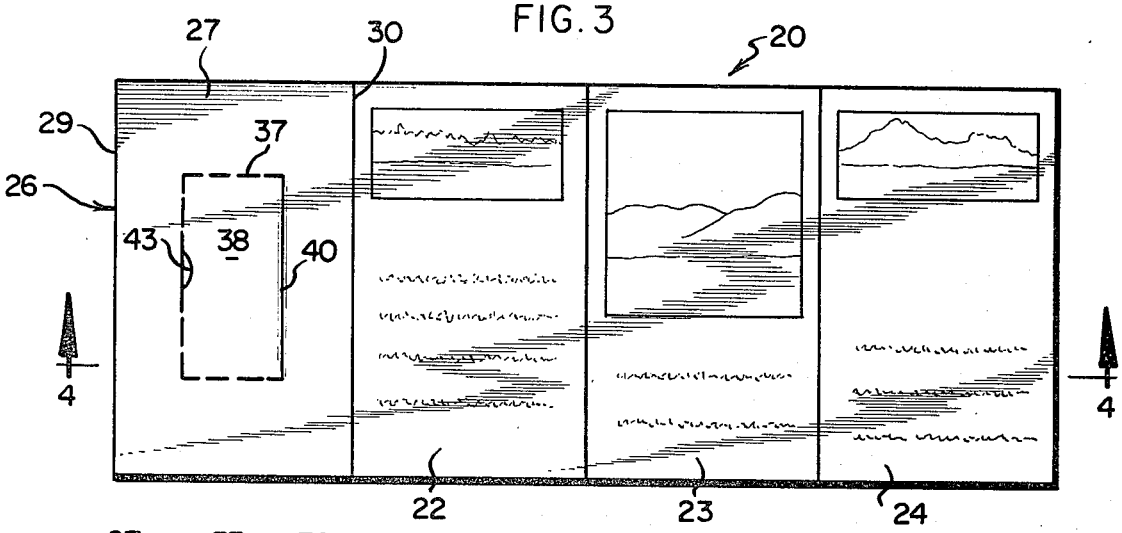
FIG. 3 is a plan view of the reply card arrangement in a subsequent stage of fabrication.
Figure 4:
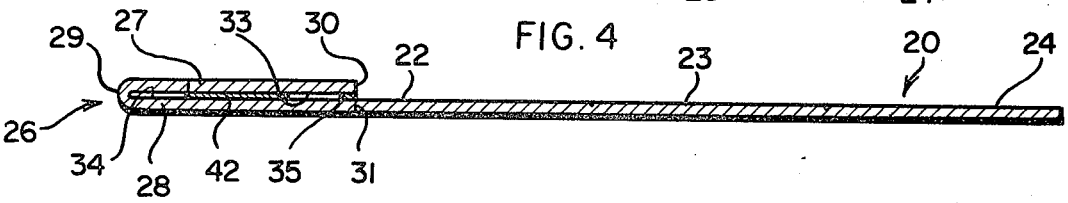
FIG. 4 is a sectional view taken along line 4—4 in FIG. 3.

First and second sheet portions 27, 28 have respective inside surfaces 33, 34 in mutually facing relation (FIGS. 4–6). Located along second side 30 of sheet portion 27 is a strip of adhesive 35 (FIG. 1), and when sheet portions 27, 28 are folded in superimposed relation, as shown in FIGS. 3 and 4, adhesive strip 35 adhesively secures together first and second sheet portions 27, 28 adjacent their respective second sides 30, 31. Located on first sheet portion 27 are discontinuous score lines 37 defining a flap 38 raisable from the remainder of first sheet portion 27 to expose to view a part 45 of the inside surface 34 of second sheet portion 28. Discontinuous score lines 37 define three sides of flap 38, and the flap has an unscored fourth side 40 integral with the remainder of first sheet portion 27.

As noted above, score lines 37 are discontinuous and interrupted, and the interruptions in score line 37 constitute tiny connecting means along the score lines for detachably connecting flap 38 to the remainder of first sheet portion 27, thereby maintaining flap 38 in the plane of sheet portion 27 until such time as the flap is torn loose from the remainder of sheet portion 27 by breaking the connections at the interruptions along score lines 37.

The inside surface of flap 38 has a marginal part adjacent score lines 37, and located along this marginal part is an adhesive 42 wettable for adhesively securing flap 38 to the inside surface 34 of second sheet portion 28.

Also located at the marginal part of flap 38 is a notch 43 for facilitating the detachment of flap 38 from the remainder of sheet portion 27 and for facilitating the opening of flap 38 after the flap has been adhesively secured to inside surface 34 of second sheet portion 28.

In the illustrated embodiment, adhesive 42 has been applied continuously along the marginal part of flap 38 on all of the three detachable sides of flap 38; but adhesive 42 can be applied to less than the entirety of the marginal part along these three sides, so long as there is sufficient adhesive to secure flap 38 to the inside surface of second sheet portion 28.

As illustrated in FIGS. 1–4, reply card 26 is assembled by folding first sheet portion 27 into superimposed relationship with second sheet portion 28 and adhesively securing the two sheet portions together with adhesive 35 along the second sides 30, 31 of sheet portions 27, 28. Thereafter, reply card 26 and the sheet portions constituting pages 22–24 are folded from the flat condition illustrated in FIGS. 3–4 through the partially folded condition illustrated in FIG. 5 to the fully folded condition illustrated in FIG. 6.

As previously noted, pages 22, 23 and 24 typically contain printed material promoting the goods or services of an offeror. The reply card arrangement is distributed by conventional means to recipients who will typically unfold reply card arrangement 20 from the folded condition, illustrated in FIG. 6, to an unfolded condition, such as that illustrated in FIG. 7, which permits the recipient to read the printed matter on pages 22–24.

Figure 8:
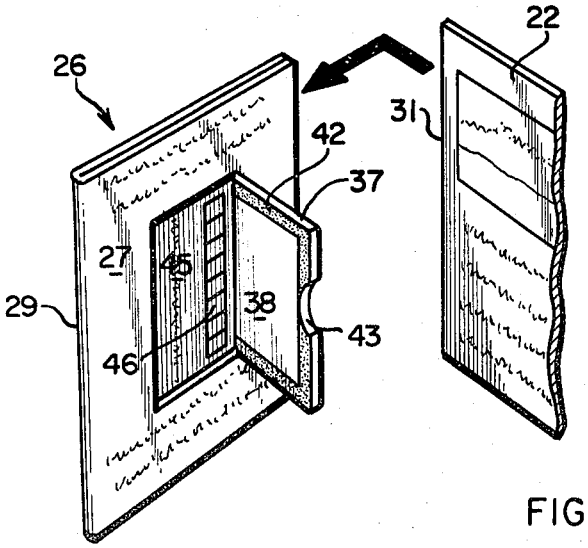
FIG. 8 is a perspective of the reply card detached from the rest of the reply card arrangement and showing the flap raised from the plane of the reply card.

When the interest of the recipient has been stimulated sufficiently to induce him to respond to the offer, the recipient-offeree detaches reply card 26 from the remainder of reply card arrangement 20 along the detachable connecting line at 31 (see FIG. 8). The offeree then detaches the three detachable sides of flap 38 from the remainder of first sheet portion 27 by grasping flap 38 at notch 43 and lifting. This tears flap 38 loose along discontinuous score lines 38, raising the flap from the plane of sheet portion 27 and exposing to view area 45 on the inside surface 34 of second sheet portion 28. Area 45 contains space for entering confidential information such as the credit card number and credit card expiration date of the offeree, e.g., as at 46.

Figure 9:
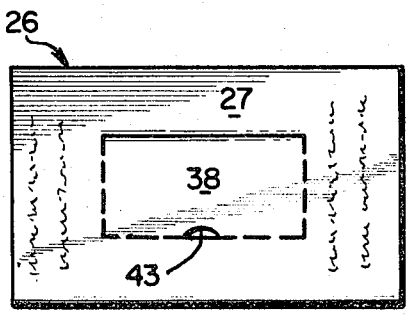
FIG. 9 is a plan view of the reply card after the flap has been adhesively secured.
Figure 10:
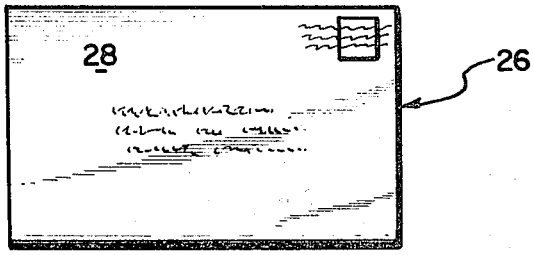
FIG. 10 is a plan view of the reply card in a condition for mailing.

After the necessary confidential information has been entered in area 45, the offeree wets adhesive 42 along the marginal part of flap 38 and secures the marginal part of flap 38 to the inside surface 34 of second sheet portion 28 (see FIG. 9). Reply card 26 is then in a condition for mailing, and the back and front of a reply card in this condition are illustrated in FIGS. 9 and 10 respectively.

When reply card 26 is received by the offeror, it may be opened by grasping flap 38 at notch 43 and lifting upwardly to tear the flap loose from the reply card and expose to view the information entered at area 45 on the inside surface of second sheet portion 28.

At all times, from the time when the offeree adhesively secures flap 38 to the inside surface of sheet portion 28 until the time when flap 38 is opened by the offeror, the confidential information entered in area 45 by the offeree is covered from view.

The foregoing detailed description has been given for clearness of understanding only, and no unnecessary limitations should be understood therefrom, as modifications will be obvious to those skilled in the art.

I claim:

1. A reply card arrangement comprising:

a first sheet portion having a pair of spaced-apart sides;

a second sheet portion having a pair of spaced-apart sides;

said first sheet portion being in superimposed relation to said second sheet portion and joined thereto at a fold line along a mutual first side of each sheet portion;

at least one other sheet portion;

means detachably joining said other sheet portion to said second sheet portion at a tearable connection along a second side of said second sheet portion;

each of said first and second sheet portions having an inside surface in mutually facing relation;

first adhesive means, on the inside surface of one of said first and second sheet portions, adhesively securing together the first and second sheet portions adjacent the second side of each;

discontinuous score lines on said first sheet portion defining flap means raisable from the remainder of said first sheet portion to expose to view a part of the inside surface of the second sheet portion;

the inside surface of said flap means having a marginal part adjacent said score lines;

and second adhesive means on at least part of said marginal part for adhesively securing said flap means to the inside surface of said second sheet portion.

2. A reply card arrangement as recited in claim 1 and comprising:

notch means in the marginal part of said flap means to facilitate opening said flap means after it has been adhesively secured to the inside surface of the second sheet portion.

3. A reply card arrangement as recited in claim 1 wherein:

said flap has three sides defined by said score lines and an unscored fourth side integral with the remainder of said first sheet portion;

said second adhesive means being located on said marginal part along all three of said sides defined by said score lines.

4. A reply card arrangement as recited in claim 1 wherein:

said first adhesive means is located on the inside surface of said first sheet portion along the second side thereof.

5. A reply card arrangement as recited in claim 1 and comprising:

connecting means along said score lines for detachably connecting said flap means to the remainder of said first sheet portion.

6. A reply card arrangement as recited in claim 1 wherein:

the inside surface of said second sheet portion comprises an exposable part which is exposed to view when said flap means is raised and which is covered from view when said flap means is adhesively secured to the inside surface of the second sheet portion;

said exposable part comprises means on which information can be written while said part is exposed to view.

* * * * *